US010947862B2

(12) United States Patent
Kim

(10) Patent No.: US 10,947,862 B2
(45) Date of Patent: Mar. 16, 2021

(54) BLADE RING SEGMENT FOR TURBINE SECTION, TURBINE SECTION HAVING THE SAME, AND GAS TURBINE HAVING THE TURBINE SECTION

(71) Applicant: DOOSAN HEAVY INDUSTRIES & CONSTRUCTION CO., LTD., Changwon-si (KR)

(72) Inventor: Inkyom Kim, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 136 days.

(21) Appl. No.: 16/159,713

(22) Filed: Oct. 15, 2018

(65) Prior Publication Data

US 2019/0120081 A1 Apr. 25, 2019

(30) Foreign Application Priority Data

Oct. 20, 2017 (KR) ..... 10-2017-0136189

(51) Int. Cl.

| | |
|---|---|
| ***F01D 25/12*** | (2006.01) |
| ***F01D 9/04*** | (2006.01) |
| ***F01D 11/08*** | (2006.01) |

(52) U.S. Cl.

CPC ..... *F01D 25/12* (2013.01); *F01D 9/04* (2013.01); *F01D 11/08* (2013.01); *F05D 2220/32* (2013.01); *F05D 2240/10* (2013.01); *F05D 2240/11* (2013.01); *F05D 2250/132* (2013.01); *F05D 2250/183* (2013.01); *F05D 2250/221* (2013.01); *F05D 2250/23* (2013.01); *F05D 2250/75* (2013.01); *F05D 2260/201* (2013.01);

(Continued)

(58) Field of Classification Search

CPC . F01D 25/12; F01D 9/04; F01D 11/08; F05D 2240/11; F05D 2260/22141

See application file for complete search history.

(56) References Cited

U.S. PATENT DOCUMENTS 7,306,424 B2 * 12/2007 Romanov ..... F01D 11/08 415/115

7,665,962 B1 2/2010 Liang (Continued)

FOREIGN PATENT DOCUMENTS

JP 2006-063984 A1 3/2006

JP 2016-128687 A 7/2016

(Continued)

*Primary Examiner* — Nathaniel E Wiehe

*Assistant Examiner* — Jackson N Gillenwaters

(74) *Attorney, Agent, or Firm* — Investone Patent, LLC

(57) ABSTRACT

Disclosed are a blade ring segment for a turbine section, a turbine section having the blade ring segment, and a gas turbine having the turbine section. Multiple blade ring segments is installed in a turbine casing accommodating turbine blades rotated by combustion gas from a combustor. The blade ring segment includes an inner panel provided in the turbine casing and having multiple air holes through which cooling air fed from the outside of the turbine casing flows, an outer panel disposed on one side of the inner panel, and a cooling structure protruding from one side of the outer panel so as to form a flowing channel in a zigzag pattern so that cooling air fed through the air holes flows therethrough.

8 Claims, 9 Drawing Sheets

(52) U.S. Cl.
CPC ..... *F05D 2260/202* (2013.01); *F05D 2260/22141* (2013.01)

(56) References Cited

U.S. PATENT DOCUMENTS

| | | | | |
|---|---|---|---|---|
| 8,099,961 | B2 * | 1/2012 | Gerendas | F23R 3/002 60/752 |
| 2014/0238031 | A1 * | 8/2014 | Okita | F23R 3/60 60/754 |
| 2017/0191417 | A1 * | 7/2017 | Bunker | F01D 25/12 |
| 2018/0266253 | A1 * | 9/2018 | Sellhorn | F01D 25/12 |
| 2019/0186278 | A1 * | 6/2019 | Clum | F01D 11/001 |
| 2020/0003060 | A1 * | 1/2020 | Rodriguez | F01D 5/187 |

FOREIGN PATENT DOCUMENTS

| | | | | |
|---|---|---|---|---|
| KR | 2005-0096604 | A | 10/2005 | |
| KR | 20050096604 | * | 10/2005 | F02C 7/18 |

* cited by examiner

BLADE RING SEGMENT FOR TURBINE SECTION, TURBINE SECTION HAVING THE SAME, AND GAS TURBINE HAVING THE TURBINE SECTION

CROSS REFERENCE TO RELATED APPLICATION

The present application claims priority to Korean Patent Application No. 10-2017-0136189, filed on Oct. 20, 2017, the disclosure of which is incorporated herein by reference in its entirety.

BACKGROUND OF THE DISCLOSURE

1. Field of the Disclosure

The present disclosure relates to a blade ring segment for a turbine which is attached to a turbine casing to prevent leakage of combustion gas and, more particularly, to a blade ring segment for a turbine having an improved cooling structure. The present disclosure also relates to a turbine section having the blade ring segment, and a gas turbine having the turbine section.

2. Description of the Background Art

Generally, turbines, such as steam turbines, gas turbines or the like, are machines that obtain rotating force with impulsive force using a flow of compressed fluid, such as gas.

The gas turbine generally includes a compressor, a combustor, and a turbine. The compressor has a compressor casing in which compressor vanes and compressor blades are alternately arranged, along with an air inlet.

The combustor serves to supply fuel to compressed air from the compressor and ignite the air-fuel gas with a burner to produce high temperature and high-pressure combustion gas.

The turbine has a turbine casing in which turbine vanes and turbine blades are alternately arranged. A rotor is centrally disposed through the compressor, the combustor, the turbine, and an exhaust chamber.

The rotor is rotatably supported by bearings at opposite ends thereof. A plurality of disks is fixed to the rotor so that respective blades are attached thereto, and a driving shaft of a driving unit, such as a generator or the like, is coupled to an end side of the rotor on the exhaust chamber side.

Since such a gas turbine is devoid of a reciprocating mechanism, such as a piston of a four-stroke engine, there is no frictional features, such as piston-cylinder contact parts, thus having advantages of a significant reduction in lubricant consumption and vibration amplitude, which is a characteristic of the reciprocating mechanism, and of enabling high speed movement.

SUMMARY OF THE DISCLOSURE

During the operation of the gas turbine, air compressed by the compressor is mixed with fuel and combusted to provide hot combustion gas in the combustor, and the combustion gas is injected towards the turbine. The injected combustion gas creates a rotating force while passing through the turbine vanes and the turbine blades, thereby rotating the rotor.

In order to prevent the leakage of high temperature and high-pressure combustion gas for rotating the rotor, and thus to improve efficiency of the gas turbine, blade ring segments are installed on the compressor and turbine stages.

Such blade ring segments are positioned to surround the outer peripheral portion of the rotating blades installed in the casing of the gas turbine. Here, in each of blade ring segments, one side facing the internal space of the casing is exposed to the high temperature and high-pressure combustion gas and subjected to high thermal load, which may damage the blade ring segment. In order to prevent the damage of the blade ring segment due to the high thermal load, a plurality of cooling channels is formed in the blade ring segment. Such cooling channels have been developed to obtain improved cooling efficiency for further protection from thermal load.

Accordingly, the present disclosure has been made keeping in mind the above problems occurring in the related art, and an object of the present disclosure is to provide a blade ring segment for a turbine whereby a structure of cooling channels through which external cooling air flows is modified to improve the cooling efficiency, a turbine section having the same, and a gas turbine having the turbine section.

Another object of the present disclosure is to provide a blade ring segment for a turbine whereby a plurality of protruding blocks forming a cooling channel for cooling air is provided with flowing holes therein so as to improve the cooling efficiency, a turbine section having the same, and a gas turbine having the turbine section.

In order to accomplish the above objects, in an aspect of the present disclosure, a blade ring segment for a turbine section is provided, wherein a plurality of blade ring segments is installed on the inside of a turbine casing accommodating turbine blades rotating with combustion gas from a combustor, the blade ring segment including: an inner panel provided on the inside of the turbine casing and having a plurality of air holes through which cooling air fed from the outside of the turbine casing flows; an outer panel disposed on one side of the inner panel; and a cooling structure protruding from one side of the outer panel so as to form a first flowing channel in a zigzag pattern so that cooling air fed through the air holes flows therethrough.

The cooling structure may include a plurality of protruding blocks each having a polygonal prism shape, wherein the protruding block may have a hexagonal prism shape.

The protruding block may be provided therein with a second flowing channel through which cooling air fed through the air holes flows, wherein the second flowing channel has a flowing hole provided in an upper surface of the protruding block at a position corresponding to the air hole, a vent hole provided in a side of the protruding block so that cooling air fed through the flowing hole flows laterally out of the protruding block therethrough, and an air passage communicating with the flowing hole and the vent hole, wherein the vent hole is formed in each side of the protruding block.

The cooling structure may include a plurality of angled pieces on the outer panel, wherein the angled pieces are arranged such that adjacent rows of angled pieces are alternately provided in a staggered arrangement with each other.

The cooling structure may include a plurality of protruding blocks on the outer panel, wherein each of the protruding blocks has a pair of cylindrical block parts and a connection block part connecting the cylindrical block parts.

In another aspect of the present disclosure, a turbine section is provided for generating power for electric power, using combustion gas from a combustor, the turbine section including: a turbine rotor having a plurality of turbine disks and a plurality of turbine blades coupled to outer circumferential surfaces of the turbine disks; a turbine casing accommodating the turbine rotor; a plurality of turbine vanes disposed on an inner circumferential surface of the turbine casing between stages of turbine blades; and a blade ring segment, wherein the blade ring segment includes: an inner panel provided on the inside of the turbine casing and having a plurality of air holes through which cooling air fed from the outside of the turbine casing flows; an outer panel disposed on one side of the inner panel; and a cooling structure protruding from one side of the outer panel so as to form a first flowing channel in a zigzag pattern so that cooling air fed through the air holes flows therethrough.

In a further aspect of the present disclosure, a gas turbine includes: a compressor section sucking and compressing air; a combustor section mixing fuel with the compressed air and combusting an air-fuel mixture to produce combustion gas; and a turbine section rotating with the combustion gas from the combustor section, wherein the turbine section includes: a turbine rotor having a plurality of turbine disks and a plurality of turbine blades coupled to outer circumferential surfaces of the turbine disks; a turbine casing accommodating the turbine rotor; a plurality of turbine vanes disposed on an inner circumferential surface of the turbine casing between stages of turbine blades; and a blade ring segment, wherein the blade ring segment includes: an inner panel provided on the inside of the turbine casing and having a plurality of air holes through which cooling air fed from the outside of the turbine casing flows; an outer panel disposed on one side of the inner panel; and a cooling structure protruding from one side of the outer panel so as to form a first flowing channel in a zigzag pattern so that cooling air fed through the air holes flows therethrough.

According to the blade ring segment for a turbine section, the turbine section having the same, and the gas turbine having the turbine section, the cooling structure, through which cooling air fed from the outside flows, is modified to improve cooling efficiency.

Furthermore, according to the blade ring segment for a turbine section, the turbine section having the same, and the gas turbine having the turbine section, with the configuration in which the protruding blocks form the flowing channel through which cooling air flows with an additional flowing passage provided therein, cooling efficiency is improved.

DETAILED DESCRIPTION OF THE DISCLOSURE

Hereinafter, a description will be made of exemplary embodiments of a blade ring segment for a turbine section, a turbine section having the same, and a gas turbine having the turbine section with reference to the accompanying drawings.

Figure 1:
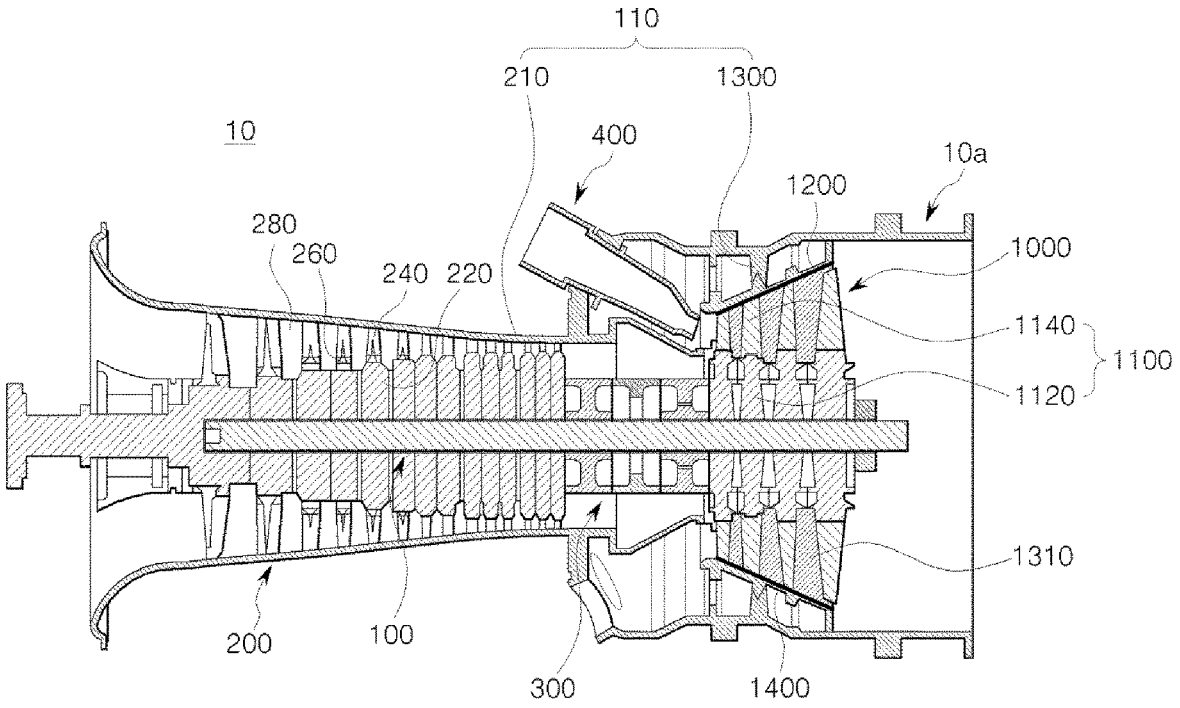
FIG. 1 is a schematic cross-sectional view of a gas turbine employing a blade ring segment for a turbine section according to a first embodiment of the present disclosure.
Figure 2:
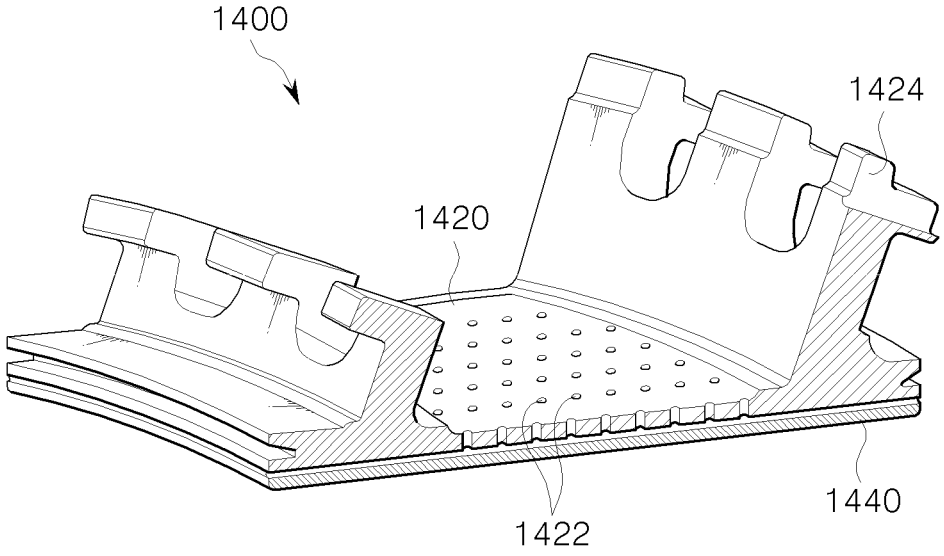
FIG. 2 is an enlarged perspective view of the blade ring segment of the first embodiment.
Figure 3:
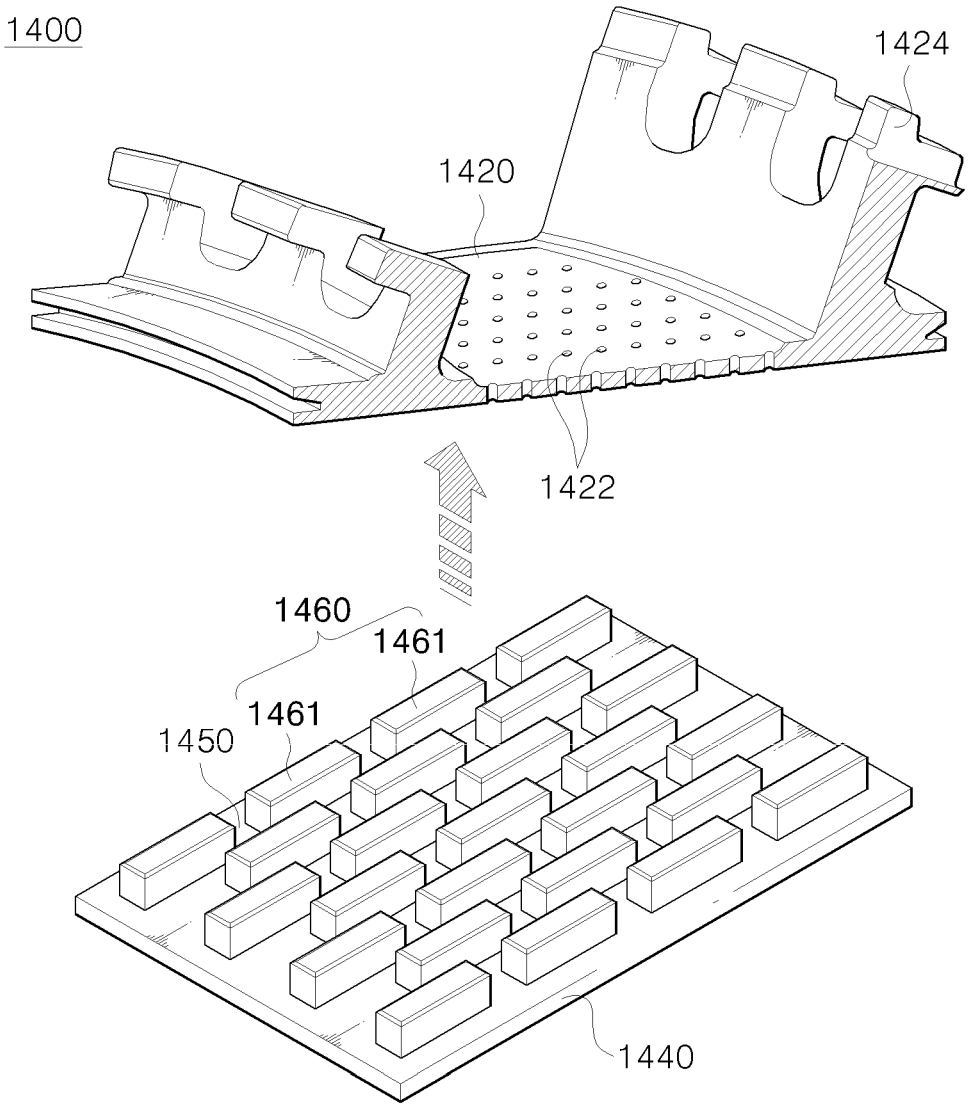
FIG. 3 is an exploded perspective view of the blade ring segment shown in FIG. 2.
Figure 4:
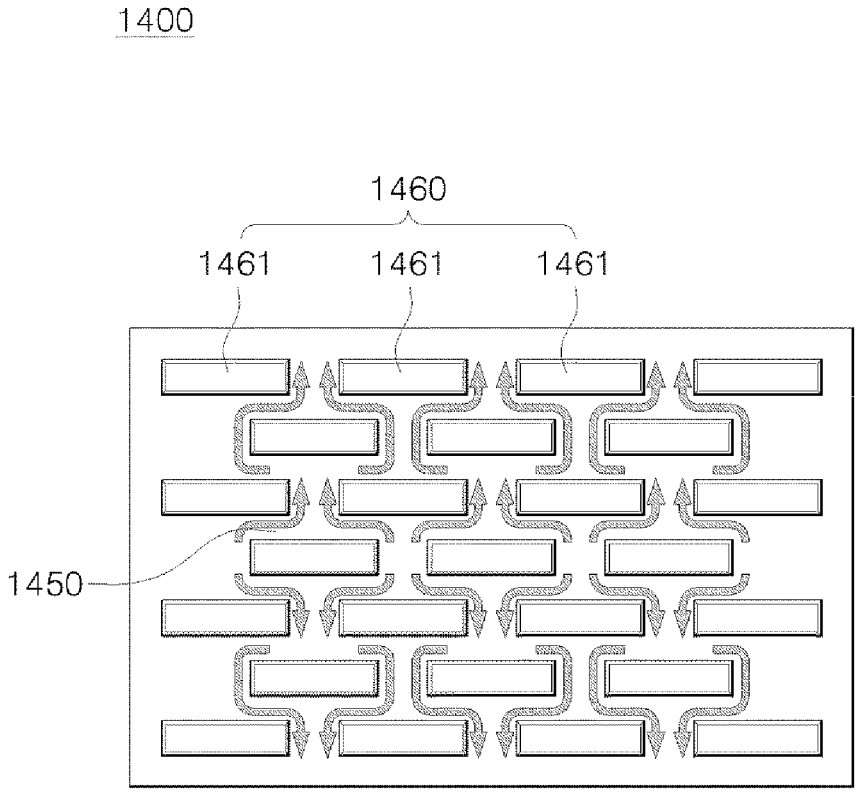
FIG. 4 is a plan view of an outer panel of the blade ring segment shown in FIG. 3.

Referring to FIG. 1, a gas turbine 10 includes a tie rod 100, a compressor 200, a torque tube 300, a combustor 400, and a turbine (also referred to as a turbine section) 1000. The tie rod is a rod member that is centrally provided through the gas turbine 10 so as to couple the compressor 200 and the turbine 1000.

The gas turbine 10 has a casing 110, which includes a compressor casing part 210 and a turbine casing part 1300, and a diffuser 10*a* provided on the rear side (the right side in the drawings) of the turbine casing part to allow the combustion gas to be discharged therethrough via the turbine 1000, wherein the combustor 400 is disposed on the front side (the left side in the drawings) of the diffuser so as to receive and combust the compressed air.

With reference to a flow of air, the compressor 200 and the turbine 1000 are disposed upstream (front side) and downstream (rear side) of the casing 110, respectively.

The torque tube 300 is preferably disposed as a torque transfer member between the compressor 200 and the turbine 1000 to transfer rotation torque generated by the turbine 1000 to the compressor 200.

The compressor 200 is provided with a plurality (e.g. 14 pieces) of compressor disks 220, each of which is coupled adjacent to the axial direction by the tie rod.

The compressor disks 220 are aligned in the axial direction with the tie rod centrally passing through the compressor disks, and the adjoining compressor disks 220 closely abut against each other at their opposed surfaces with the tie rod so that they cannot rotate relative to each other.

A plurality of compressor blades 240 is radially coupled to an outer circumferential surface of the compressor disk 220 by means of a root member 260 thereof.

A plurality of compressor vanes 280 is fixedly disposed on the compressor casing 210 between the compressor disks 220. Unlike the compressor disks 220, the compressor vanes 280 are not rotatable so that they serve to align a flow of compressed air from the compressor blades 240 on the upstream-side compressor disk 220 and guide the flow towards those on the downstream-side compressor disk 220.

The root member 260 of the compressor blade has a tangential or axial type coupling means. The coupling type can be selected according to the types of available gas turbines. The coupling type may be a dovetail or fir-tree type. If needed, other coupling means including fittings, such as keys, bolts, or the like, may be used to couple the compressor blade and the compressor rotor disk.

The tie rod is provided, centrally passing through the compressor disks 220, wherein one side thereof is coupled to the compressor disk 220 on the most upstream side, and another side thereof is coupled to the torque tube 300.

The combustor 400 serves to mix fuel with the introduced compressed air and combust the air-fuel mixture to produce high temperature and high-pressure combustion gas with high energy, which is then heated to the heat-resisting temperature of the combustor and turbine parts through an isobaric combustion process.

The combustor of the gas turbine comprises a plurality of combusting units in the cell-type casing, wherein each of the combusting units includes a burner having a fuel injecting nozzle and the like, a combustor liner forming a combustion chamber, and a transition piece forming a connection between the combustor and the turbine.

Specifically, the liner provides a combustion space in which fuel injected through the fuel nozzle is mixed with the compressed air from the compressor and the air-fuel mixture is combusted. The liner may include a flame container providing the combustion space in which the air-fuel mixture is combusted and a flow sleeve surrounding the flame container to form an annular space. Further, the fuel nozzle and an ignition plug are coupled to a front side and a side wall of the liner, respectively.

In the meantime, the transition piece is coupled to a rear side of the liner to allow the combustion gas combusted by the ignition plug to be transferred towards the turbine. An outer wall of the transition piece is cooled by the compressed air fed from the compressor to prevent it from being damaged by hot combustion gas.

To this end, the transition piece is provided with cooling holes through which compressed air is introduced into the transition piece for cooling components therein, and then flows towards the liner.

The annular space of the liner is fed with cooling air through the transition piece, and the outer wall of the liner is fed therein with compressed cooling air through cooling holes of the flow sleeve from the outside of the flow sleeve, so that two flows of compressed air may collide with each other.

High temperature and pressure combustion gas from the combustor 400 is fed to the turbine 1000. Then, the high temperature and pressure combustion gas expands and impacts rotating blades of the turbine to cause rotating torque, which is in turn transferred to the compressor 200 via the torque tube to drive the compressor, and power exceeding the power to drive the compressor is used to drive a generator or the like.

The structure of the turbine 1000 is basically similar to that of the compressor 200. The turbine 1000 includes a plurality of turbine disks 1120 and a plurality of turbine rotors 1100 comprising a plurality of turbine blades 1140.

The turbine blades 1140 are coupled to outer circumferential surfaces of the turbine disks 1120, which are radially provided on an outer circumferential surface of the tie rod so that the turbine disks are rotated with combustion gas fed from the combustor 400.

The turbine blade 1140 is coupled to the turbine disk 1120 in a dovetail-type coupling manner or the like, and a plurality of turbine vanes 1310 is fixed to the turbine casing part 1300 between stages of turbine blades provided on the outer circumferential surface of the tie rod so as to guide a flow of combustion gas passed through the turbine blades 1140.

The turbine vanes 1310 are disposed in multiple stages along the circumferential direction of the turbine casing part 1300. Preferably, stages of turbine vanes 1310 alternate with stages of turbine blades along the axial direction of the tie rod.

Referring to FIGS. 1 to 4, a plurality of blade ring segments 1400 for a turbine is installed in the turbine casing part, wherein each of the blade ring segment serves to cool the turbine casing part 1300 while preventing leakage of combustion gas.

The blade ring segment 1400 includes an inner panel 1420 and an outer panel 1440. The inner panel 1420 is provided with a plurality of air holes 1422 through which cooling air fed from the outside of the turbine casing flows. The inner panel has attachment parts 1424 on opposite ends thereof so as to attach the inner panel 1420 to the turbine casing part.

The outer panel 1440 is disposed on one side of the inner panel 1420. The outer panel is provided on one side thereof with a cooling structure 1460 having a first flowing channel through which cooling air is fed through the air holes.

The cooling structure 1460 has a plurality of protruding blocks 1461, each of which extends in a rectangular parallelepiped shape in one direction. The first flowing channel 1450 defined by the protruding blocks 1461 is formed in a zigzag pattern. Since the cooling air fed through the air holes 1422 flows along the first zigzag flowing channel 1450, instead of a conventional linear flowing channel, the cooling air suffers from high flowing resistance and thus is held longer in the first flowing channel, thereby cooling the blade ring segment more efficiently.

As described above, the cooling structure 1460 has the plurality of rectangular parallelepiped protruding blocks in multiple rows. However, the protruding block 1461 may be of another polygonal prism shape so long as it can form a zigzag flowing channel. Rows of protruding blocks 1461 are alternately provided in a staggered arrangement with each other, thereby forming the first flowing channel 1450 having a zigzag pattern. Further, the longitudinal direction of the protruding blocks is parallel with the axial direction of the turbine casing part, so that when cooling air fed through the air holes flows horizontally, the cooling air flows along the zigzag flowing channel, thereby improving cooling efficiency.

Figure 5:
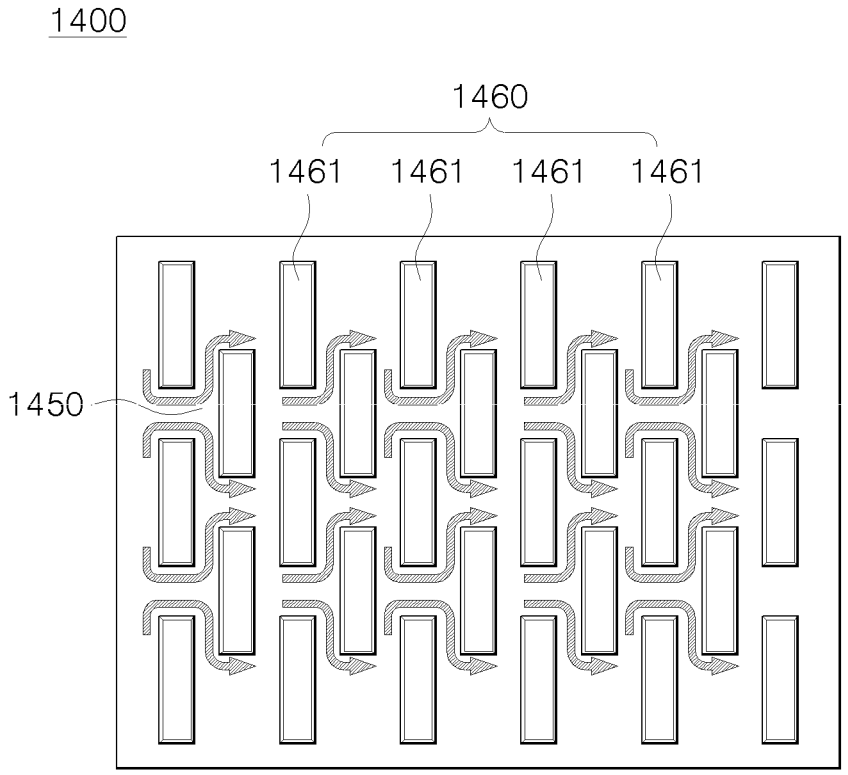
FIG. 5 is a plan view of a modified example of the outer panel of the first embodiment.

FIG. 5 is a plan view of a modified example of the outer panel according to the first embodiment. Referring to FIG. 5, the rectangular parallelepiped blocks 1461 are arranged such that the longitudinal direction thereof is perpendicular to an axis of the turbine casing part. When flowing from the upstream to the downstream of the turbine, the cooling air fed through the air holes flows along the first flowing channel 1450 having a zigzag pattern.

Figure 6:
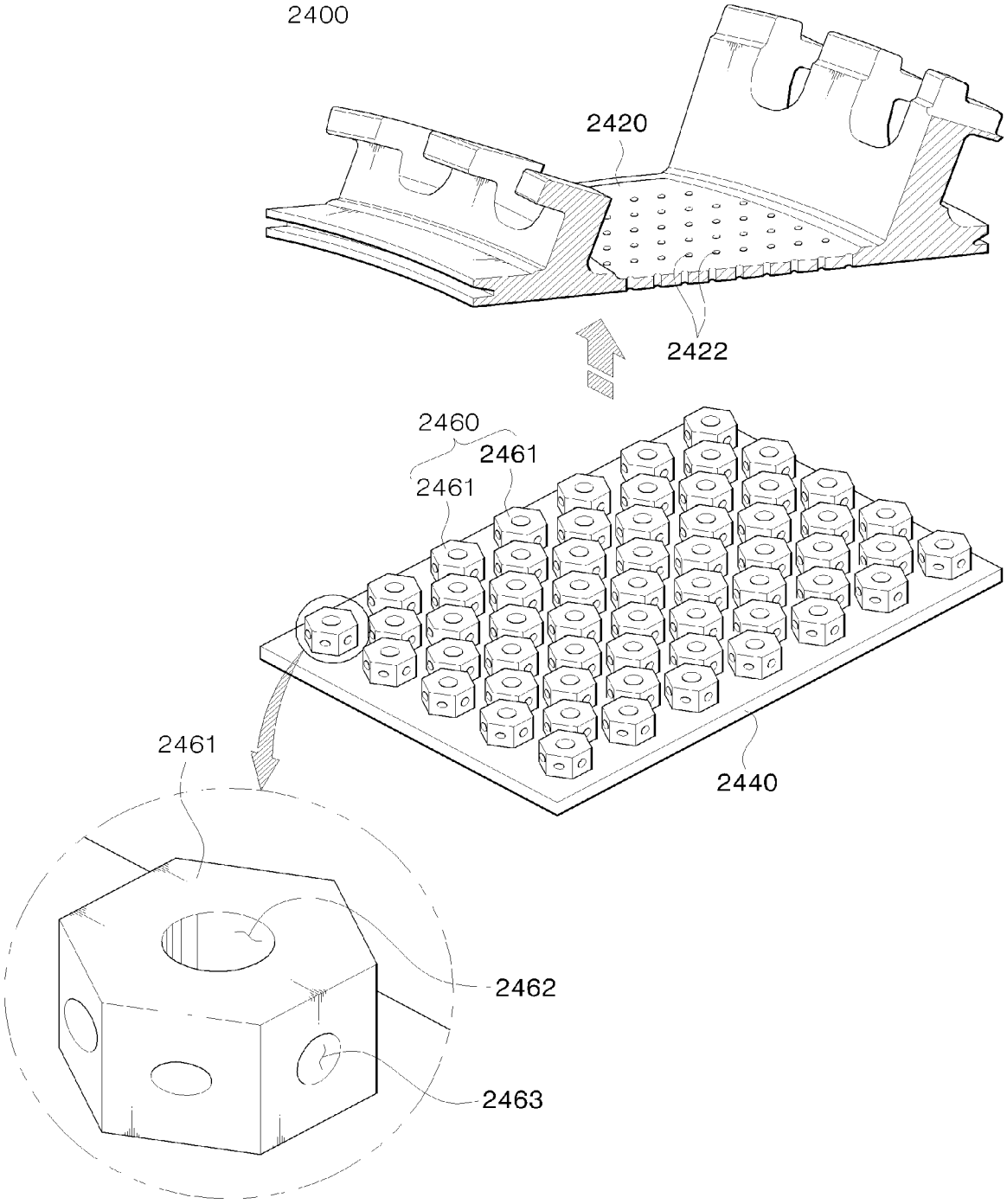
FIG. 6 is an exploded perspective view of a blade ring segment for a turbine section according to a second embodiment of the present disclosure.
Figure 7:
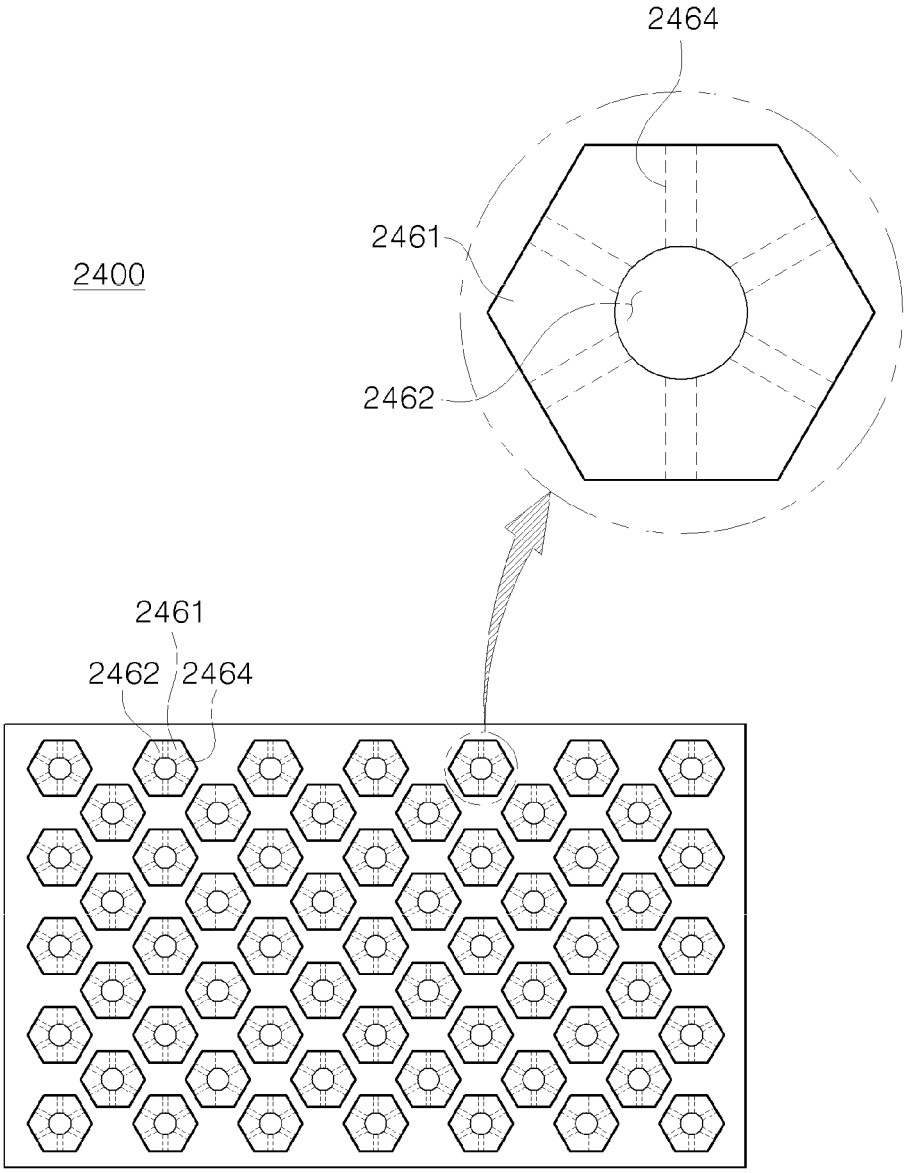
FIG. 7 is a plan view of an outer panel of the blade ring segment shown in FIG. 6.

FIG. 6 is an exploded perspective view of a blade ring segment for a turbine section according to a second embodiment of the present disclosure, and FIG. 7 is a plan view of an outer panel of the blade ring segment shown in FIG. 6.

Referring to FIGS. 6 and 7, the blade ring segment 2400 according to the second embodiment includes an inner panel 2420, an outer panel 2440, and a cooling structure 2460.

The blade ring segment is different from that of the first embodiment in that the cooling structure is modified.

The same components of the blade ring segment as that of the first embodiment will not be described, but the cooling structure 2460 different from that of the first embodiment will be described.

The cooling structure 2460 has rows of protruding blocks 2461 each having a hexagonal prism shape. Rows of protruding blocks 2461 are alternately provided in a staggered arrangement with each other, thereby forming a first flowing channel having a zigzag pattern.

The protruding block 2461 is provided therein with a plurality of second flowing channels through which cooling air fed through air holes 2422 flows. The protruding block 2461 is provided in an upper surface thereof with a flowing hole 2462 at a position corresponding to the air hole so that cooling air is introduced through the flowing hole. Further, each of six faces of the protruding block 2461 is provided with a vent hole 2463. Air passages 2464 are formed in the protruding block 2461 to communicate with the flowing hole 2462 and the vent holes 2463.

That is, the air passages 2464 extend from the flowing hole 2462 to the vent holes 2463.

Thus, cooling air fed through the air holes 2422 of the inner panel flows into the protruding block 2461 through the flowing hole 2462 so as to cool the protruding block and the outer panel. After cooling the protruding block 2461, the cooling air is discharged to the outside of the protruding block 2461 through the air passages 2464 and the vent holes 2463. After discharged to the outside of the protruding block 2461 through the vent holes 2463, the cooling air impacts and cools adjacent protruding blocks, and then flows along the first flowing channel so as to cool the outer panel.

As such, cooling air fed through the air holes of the inner panel flows sequentially through the air passages and first flowing channel to efficiently cool the outer panel and the protruding blocks.

Figure 8:
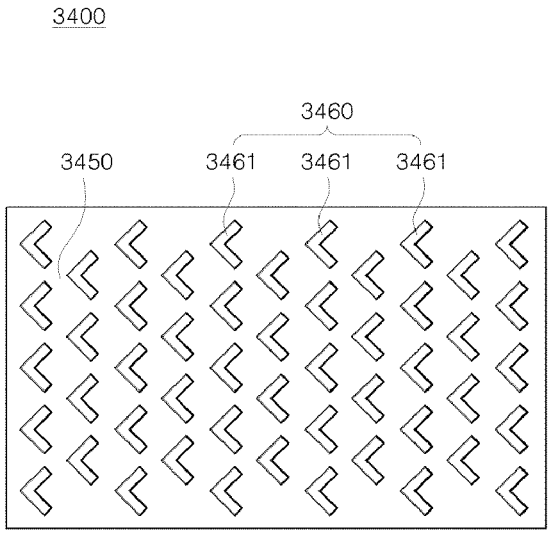
FIG. 8 is a plan view of an outer panel of a blade ring segment for a turbine section according to a third embodiment of the present disclosure.

FIG. 8 is a plan view of an outer panel of a blade ring segment for a turbine section according to a third embodiment of the present disclosure.

Referring to FIG. 8, the blade ring segment 3400 according to the third embodiment includes an inner panel, an outer panel, and a cooling structure.

The blade ring segment is different from that of the first embodiment in that the cooling structure is modified.

The same components of the blade ring segment as that of the first embodiment will not be described, but the cooling structure different from that of the first embodiment will be described.

The cooling structure 3460 has a plurality of angled pieces 3461. The angled pieces are arranged such that adjacent rows of angled pieces 3461 are alternately provided in a staggered arrangement with each other, thereby forming a first flowing channel 3450 having a zigzag pattern.

The angled piece 3461 each have a 'A'-type sectional shape, and adjacent angled pieces are alternately disposed in a staggered arrangement to form the first flowing channel 3450 in a zigzag pattern. Thus, cooling air fed through air holes of the inner panel flows along the zigzag flowing channel 3450 formed between adjacent angled pieces so as to cool the outer panel.

An inner angle of the 'A'-type angled piece 3461 may be adjusted depending on a flow rate of cooling air. For example, the inner angle of the 'A'-type angled piece is increased or decreased in order to reduce or increase flow resistance of cooling air, respectively.

Figure 9:
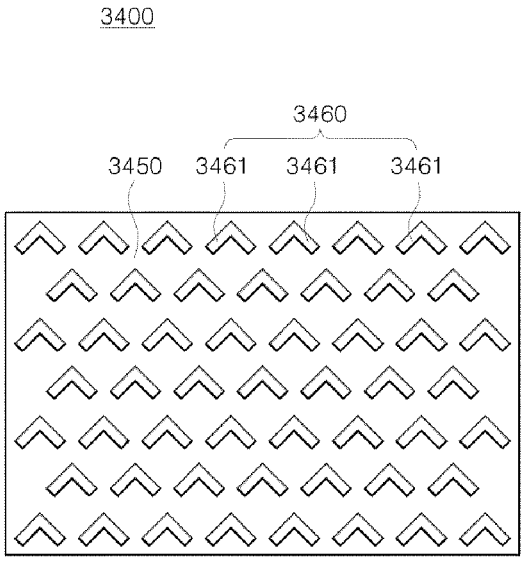
FIG. 9 is a plan view of a modified example of the outer panel of the blade ring segment according to the third embodiment.

Alternatively, the arrangement of the angled pieces may be modified into a variety of forms. For example, as illustrated in FIG. 9, the angled pieces may be arranged in a 90°-rotated form.

Figure 10:
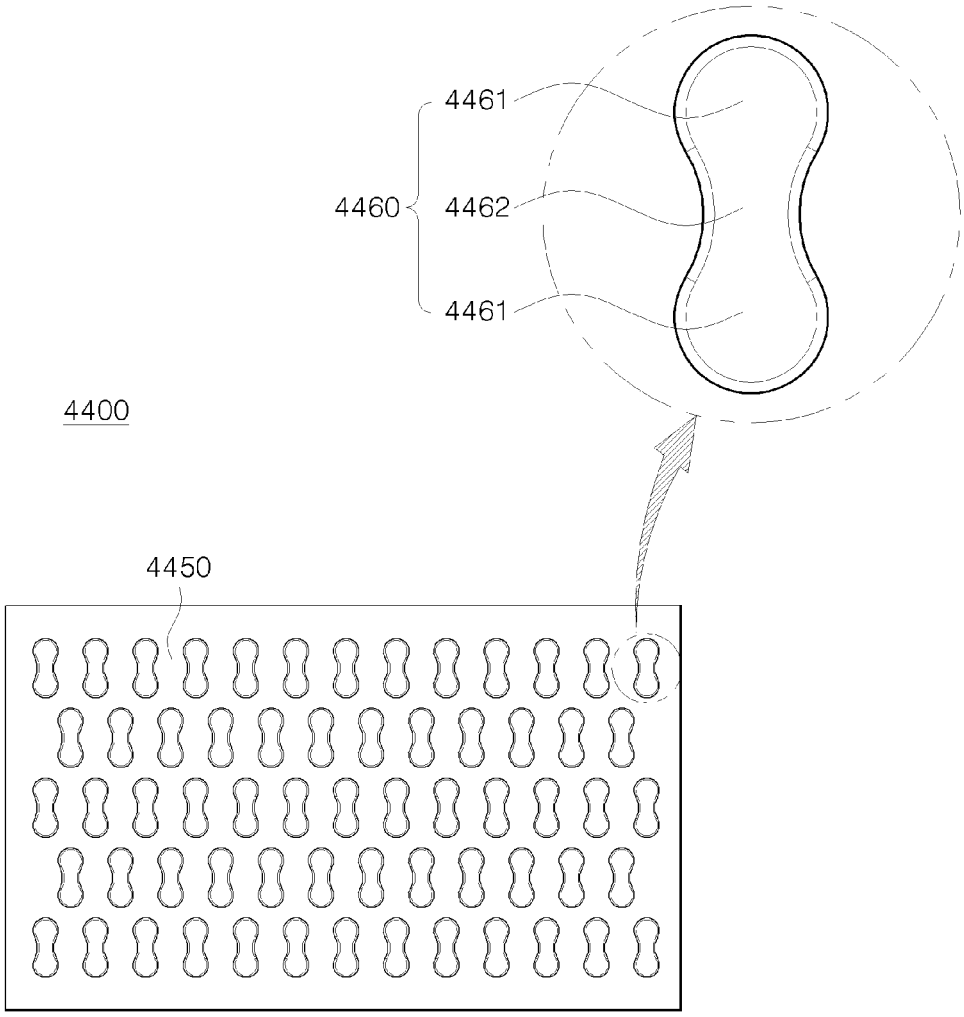
FIG. 10 is a plan view of an outer panel of a blade ring segment for a turbine section according to a fourth embodiment of the present disclosure.

FIG. 10 is a plan view of an outer panel of a blade ring segment for a turbine section according to a fourth embodiment of the present disclosure.

Referring to FIG. 10, the blade ring segment 4400 according to the fourth embodiment includes an inner panel, an outer panel, and a cooling structure.

The blade ring segment is different from that of the first embodiment in that the cooling structure is modified.

The same components of the blade ring segment as that of the first embodiment will not be described, but the cooling structure 4460 different from that of the first embodiment will be described.

The cooling structure 4460 has a plurality of protruding blocks each having a pair of protruding block parts 4461 and a connection block part 4462 connecting the protruding block parts.

The protruding block parts 4461 have a cylindrical shape, and the connection block part 4462 is disposed between the protruding block parts, wherein a width of the connection block part is smaller than those of the protruding block parts. Thus, a protruding block composed of the cylindrical block parts 4461 and the connection block part 4462 is of a peanut shape when viewed from the top. Cooling air fed through air holes of the inner panel flows along outer circumferential surfaces of the cylindrical block parts and the connection block part of the protruding block and then between adjacent protruding blocks. It will be appreciated by those skilled in the art that the embodiments of the present disclosure described above are merely illustrative and that various modifications and equivalent embodiments are possible without departing from the scope and spirit of the disclosure. Therefore, it will be appreciated that the present disclosure is not limited to the form set forth in the foregoing description. Accordingly, the true scope of technical protection of the present disclosure should be determined by the technical idea of the appended claims. It is also to be understood that the present disclosure covers all modifications, equivalents, and alternatives falling within the spirit and the scope of the present disclosure as defined by the appended claims.

The invention claimed is:

1. A blade ring segment for a turbine section of a gas turbine, the blade ring segment comprising:

an inner panel provided in a turbine casing of the turbine section, the inner panel having a plurality of air holes through which cooling air flows;

an outer panel disposed on a side of the inner panel; and a cooling structure comprising a plurality of protruding blocks arranged to correspond to the plurality of air holes, respectively, each of the plurality of protruding blocks having a hexagonal prism shape and protruding from a side of the outer panel so as to form a first flowing channel in a zigzag pattern across the side of the outer panel, the cooling structure forming a second flowing channel through each of the plurality of protruding blocks, the second flowing channel including:

a flowing hole that is formed in an upper surface of a corresponding protruding block of the plurality of protruding blocks and communicates with a corresponding air hole of the plurality of air holes, and a vent hole that is formed in each lateral surface of the corresponding protruding block and communicates with the flowing hole.

2. The blade ring segment of claim 1, wherein the cooling structure is configured to cool the plurality of protruding blocks by drawing the cooling air through the plurality of air holes of the inner panel such that the cooling air flows through the plurality of protruding blocks from the flowing hole of each of the plurality of protruding blocks to the vent hole of each of the plurality of protruding blocks.

3. The blade ring segment of claim 2, wherein the second flowing channel further includes an air passage communicating with the flowing hole and the vent hole and is configured to discharge the cooling air from the vent hole, the discharged cooling air impacting protruding blocks of the plurality of protruding blocks that are adjacent to the corresponding protruding block and then flowing along the first flowing channel so as to cool the outer panel.

4. A turbine section for generating power using combustion gas from a combustor, the turbine section comprising:

a turbine rotor having a plurality of turbine disks and a plurality of turbine blades coupled to outer circumferential surfaces of the turbine disks;

a turbine casing accommodating the turbine rotor;

a plurality of turbine vanes disposed on an inner circumferential surface of the turbine casing between stages of turbine blades; and a blade ring segment comprising:

an inner panel provided in the turbine casing, the inner panel having a plurality of air holes through which cooling air flows;

an outer panel disposed on a side of the inner panel; and a cooling structure comprising a plurality of protruding blocks arranged to correspond to the plurality of air holes, respectively, each of the plurality of protruding blocks having a hexagonal prism shape and protruding from a side of the outer panel so as to form a first flowing channel in a zigzag pattern across the side of the outer panel, the cooling structure forming a second flowing channel through each of the plurality of protruding blocks, the second flowing channel including:

a flowing hole that is formed in an upper surface of a corresponding protruding block of the plurality of protruding blocks and communicates with a corresponding air hole of the plurality of air holes, and a vent hole that is formed in each lateral surface of the corresponding protruding block and communicates with the flowing hole.

5. The turbine section of claim 4, wherein the cooling structure is configured to cool the plurality of protruding blocks by drawing the cooling air through the plurality of air holes of the inner panel such that the cooling air flows through the plurality of protruding blocks from the flowing hole of each of the plurality of protruding blocks to the vent hole of each of the plurality of protruding blocks.

6. The turbine section of claim 5, wherein the second flowing channel further includes an air passage communicating with the flowing hole and the vent hole and is configured to discharge the cooling air from the vent hole, the discharged cooling air impacting protruding blocks of the plurality of protruding blocks that are adjacent to the corresponding protruding block and then flowing along the first flowing channel so as to cool the outer panel.

7. A gas turbine comprising:

a compressor section sucking and compressing air;

a combustor section mixing fuel with the compressed air and combusting an air-fuel mixture to produce combustion gas; and a turbine section rotated by the combustion gas from the combustor section, wherein the turbine section includes:

a turbine rotor having a plurality of turbine disks and a plurality of turbine blades coupled to outer circumferential surfaces of the turbine disks;

a turbine casing accommodating the turbine rotor;

a plurality of turbine vanes disposed on an inner circumferential surface of the turbine casing between stages of turbine blades; and a blade ring segment comprising:

an inner panel provided in the turbine casing, the inner panel having a plurality of air holes through which cooling air flows;

an outer panel disposed on a side of the inner panel; and a cooling structure comprising a plurality of protruding blocks arranged to correspond to the plurality of air holes, respectively, each of the plurality of protruding blocks having a hexagonal prism shape and protruding from a side of the outer panel so as to form a first flowing channel in a zigzag pattern across the side of the outer panel, the cooling structure forming a second flowing channel through each of the plurality of protruding blocks, the second flowing channel including:

a flowing hole that is formed in an upper surface of a corresponding protruding block of the plurality of protruding blocks and communicates with a corresponding air hole of the plurality of air holes, and a vent hole that is formed in each lateral surface of the corresponding protruding block and communicates with the flowing hole.

8. The gas turbine of claim 7, wherein the cooling structure is configured to cool the plurality of protruding blocks by drawing the cooling air through the plurality of air holes of the inner panel such that the cooling air flows through the plurality of protruding blocks from the flowing hole of each of the plurality of protruding blocks to the vent hole of each of the plurality of protruding blocks, and wherein the second flowing channel further includes an air passage communicating with the flowing hole and the vent hole and is configured to discharge the cooling air from the vent hole, the discharged cooling air impacting protruding blocks of the plurality of protruding blocks that are adjacent to the corresponding protruding block and then flowing along the first flowing channel so as to cool the outer panel.

* * * * *